US005282766A

United States Patent [19]

Fleet

[11] Patent Number: 5,282,766

[45] Date of Patent: Feb. 1, 1994

[54] TOY FISH WITH INNER FIGURINE

[76] Inventor: Philip B. Fleet, 3313 Wyndham Cir., No. 1218, Alexandria, Va. 22302

[21] Appl. No.: 888,655

[22] Filed: May 27, 1992

[51] Int. Cl.[5] ..... A63H 3/00; A63H 23/00; A63H 3/36

[52] U.S. Cl. ..... 446/72; 446/75; 446/153; 446/395

[58] Field of Search ..... 446/72, 73, 75, 76, 446/153, 156, 157, 158, 268, 278, 368, 371, 395, 304

[56] References Cited

U.S. PATENT DOCUMENTS

| | | | |
|---|---|---|---|
| 325,141 | 8/1885 | Wilke | 446/304 |
| 753,335 | 3/1904 | Ward | 446/304 X |
| 985,746 | 2/1911 | Lewis | 446/304 X |
| 1,199,183 | 9/1916 | Hill | 446/304 X |
| 4,068,401 | 1/1978 | Saitoh | 446/158 |
| 4,257,610 | 3/1981 | Ptaszek et al. | 446/304 X |
| 4,775,351 | 10/1988 | Provenzano, Jr. | 446/278 X |
| 4,778,433 | 10/1988 | McKay et al. | 446/304 |
| 4,964,831 | 10/1990 | Wolff | 446/268 X |
| 5,141,464 | 8/1992 | Stern et al. | 446/395 X |

FOREIGN PATENT DOCUMENTS

| | | | |
|---|---|---|---|
| 701441 | 12/1940 | Fed. Rep. of Germany | 446/395 |
| 1091268 | 4/1955 | France | 446/304 |
| 1381500 | 1/1975 | United Kingdom | 446/304 |
| 2046603 | 11/1980 | United Kingdom | 446/158 |
| 2239611 | 7/1991 | United Kingdom | 446/73 |

OTHER PUBLICATIONS

"Aquaphibian" Lakeside Toys Catalogue, 1966.

*Primary Examiner*—David N. Muir
*Attorney, Agent, or Firm*—Aquilino & Welsh

[57] ABSTRACT

An educational collector's series floating toy fish having a hollow interior chamber. The mouth of the toy fish communicates with the interior chamber to define an opening through which the inside of the toy fish may be viewed. Located within the interior chamber is a figurine displaying one or more characters in a thought-inspiring pose or situation. A story booklet receivable within the packaging proposing at least one explanation as to how or why the figurine ended up inside the toy fish is also included.

1 Claim, 2 Drawing Sheets

TOY FISH WITH INNER FIGURINE

BACKGROUND OF THE INVENTION

1. Field of the Invention

The present invention relates to educational toys, more particularly, to a collector's series of floating toy fish which include an imagination-inspiring figurine located inside of each toy fish. The fish is accompanied by a story booklet setting forth several versions of how or why the figurine came to be located inside of the toy fish.

2. Discussion of the Prior Art

There are numerous prior art aquatic toys, such as those to Ganine (D 153,426), Leaf (D 153,707) and Saitoh (D 251,315), however, these toys fail to show an aquatic toy like the present invention. The patents to Ganine and Leaf merely display floating toys in the shape of a fish, while the patent to Saitoh shows a toy fish chasing a smaller fish.

Another patent of interest is that to Damiani (D 188,958), which shows a bottle in the shape of a fish having a screw cap at its mouth.

Although numerous other examples of simulated toy fish exist, none provide the thought inspiring feature of the present invention.

SUMMARY OF THE INVENTION

The toy fish of the present invention is in the form of a floating toy having a hollow interior. The interior is accessed through an opening formed by the mouth of the toy fish. The mouth is openable and closeable so as to provide viewing access to a figurine located within the toy fish. The figurine may be in the form of one or more characters in various thought-provoking situations or poses. A story booklet accompanies the toy fish and starts a child's thought process by setting forth several possible explanations on how or why the figurine came to be located within the toy fish.

It is an object of the present invention to provide a play toy for a child which will provide physical enjoyment as well as mental stimulation.

It is another object of the present invention to create an educational toy which will inspire a child's imagination process and encourage him or her to transform his or her thoughts into a written format.

It is still another object of the present invention to provide a series of toy fish, thereby providing the added enjoyment of obtaining a complete collection.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein, however, it is to be understood that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
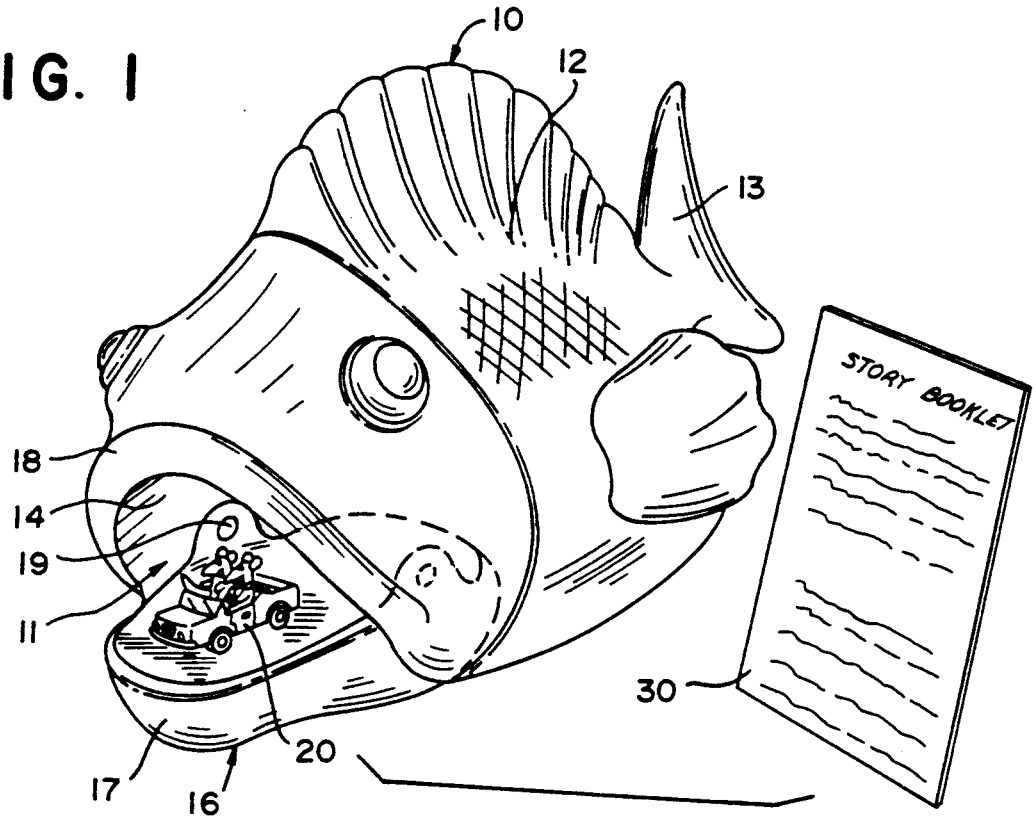
FIG. 1 shows a perspective view of the present invention.
Figure 2:
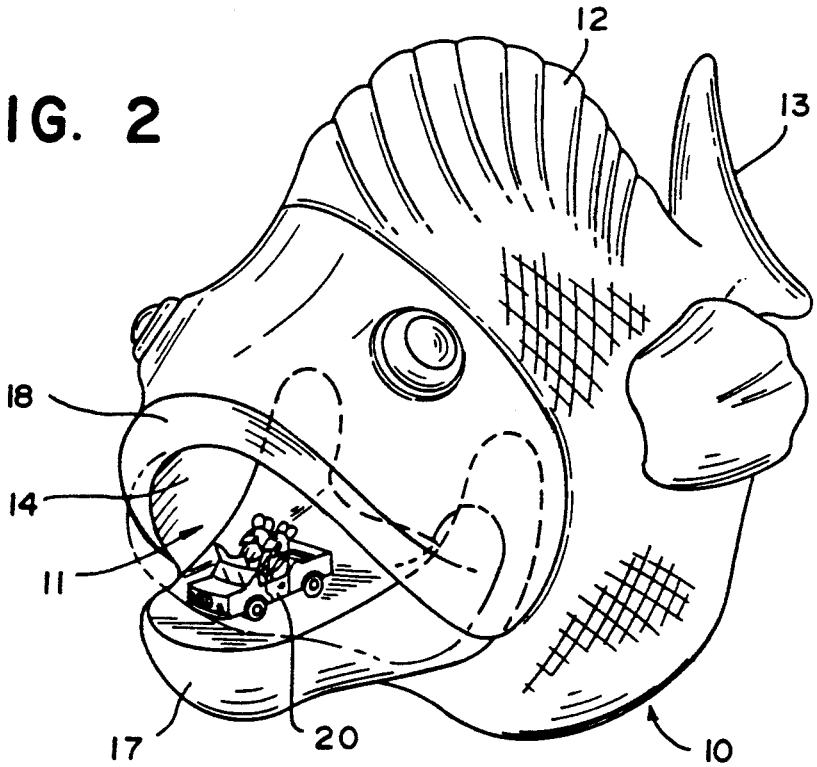
FIG. 2 shows a perspective view of a second embodiment of the present invention.

Referring to FIG. 1, an example of a toy fish 10 according to the present invention is shown. The toy fish 10 includes a simulated fish-shaped body 12 which can take the form of a variety of different types of fish. The fish-shaped body 12 includes a mouth 16 at one end and a tail 13 at its other end. The inside of the fish-shaped body 12 is hollow and forms an interior chamber 14. The fish-shaped body 12, as well as the rest of the device, is preferably manufactured from a plastic, but could be made from any suitable material, such as wood or metal, as long as the toy fish 10 floats. The fish-shaped body 12 of toy fish 10 includes an opening 11 in communication with interior chamber 14 defined by mouth 16. A portion of the mouth 16 can be movably attached to the rest of the fish-shaped body 12, such that the mouth 16 can be opened or closed to allow access to the interior chamber 14. In the preferred embodiment of FIG. 1, the mouth 16 includes a stationary upper mouth portion 18 and a movable lower mouth portion 17 pivotally attached to the fish-shaped body 12 by pivot pins 19. In FIG. 2, the moveable mouth portion 17 is shown to be slidably attached to the fish-shaped body 12 such that the mouth can be slid open and closed to allow access to interior chamber 14. As shown, the lower mouth portion is movable, but it is obvious that this could be reversed with the upper mouth portion being movable.

Located within interior chamber 14 is figurine 20 having characters in an amusing pose or situation. For example, two mice riding in a convertible, a boy with a fishing pole and dog and/or a penguin ice hockey game. The figurine 20 can be permanently mounted within the toy fish 10 so as to be viewable when mouth 16 is opened. The figurine 20 may be secured to the movable mouth portion 17 or it may be secured to a portion of the interior chamber 14 so as to be viewable when the mouth 16 is opened.

As shown in FIG. 1, a story booklet 30 is provided as part of the invention. The story booklet 30 can be packaged within the interior chamber 14 of the toy fish 10 or it may be simply enclosed within the point of purchase packaging. The story booklet 30 includes a plurality of story sheets containing the following information: (A) the name of the toy fish 10 and an explanation of how or why the figurine ended up inside the toy fish 10 from the manufacturers, (B) an assortment of children's published submissions on their versions on how or why the figurines are inside the toy fish and (C) pre-printed sheets with blanks to encourage the toy fish's new owner to submit his own version as to how or why the figurines are located within the toy fish 10.

Figure 3:
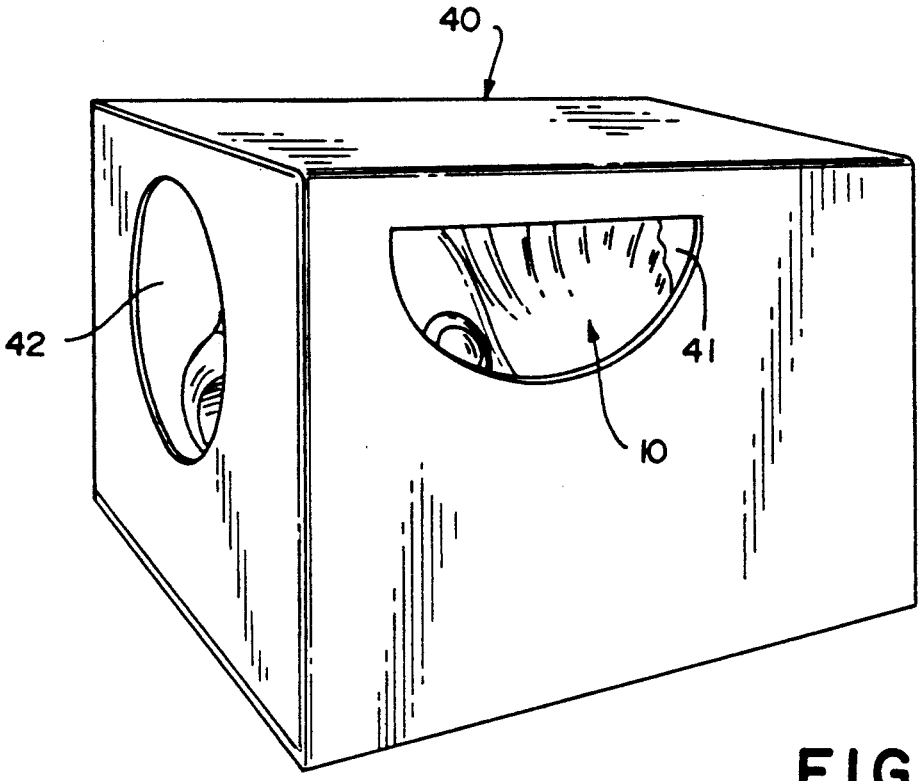
FIG. 3 shows a perspective view of the point of purchase packaging with the present invention located therein.
Figure 4:
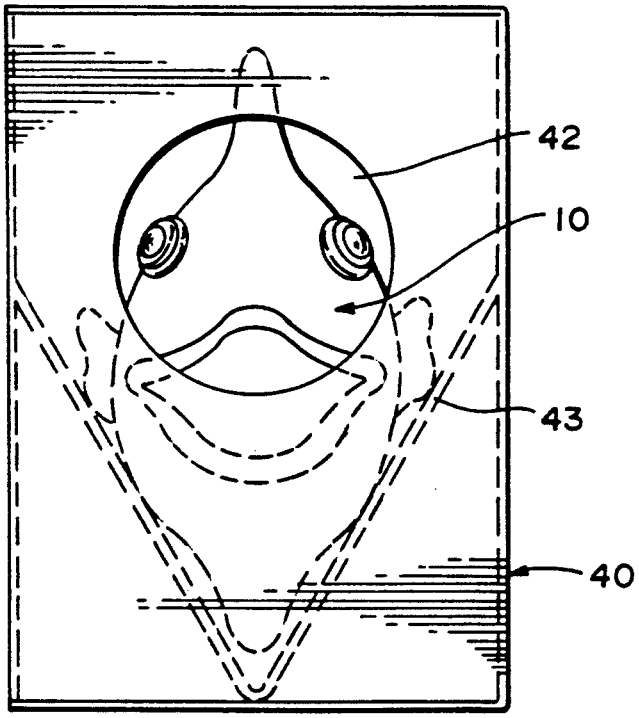
FIG. 4 shows a front view of the present invention located within the point of purchase packaging, showing the display stand located within the packaging in dotted lines.

Another aspect of the invention will be described with reference to FIGS. 3 and 4 in which the point of purchase packaging is shown. The package 40 will include viewing holes 41 and 42 and an interior platform 43 configured to form a stand for maintaining the toy fish 10 in an upright display position.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A floating toy fish, comprising:

a simulated fish-shaped body having a tail at one end and a mouth at an opposite end;

said body having a hollow interior forming a chamber having an opening defined by the mouth of the simulated fish which forms an opening in communication with said interior chamber;

said mouth including a jaw portion which is retractable for guided movement by means within said simulated fish-shaped body so as to be openable in order to expose an interior mouth surface;

said portion having an exterior surface configured to simulate a fish mouth and said interior surface upon which a whimsical figurine is permanently attached, whereby when said mouth is opened the whimsical figurine becomes viewable; and an accompanying story booklet setting forth several stories, originated by manufacturer and pre-printed sheets with blank lines for encouraging the toy's owner to create and submit for publication in future booklets his or her own story on how said figurine ended up within said simulated fish.

* * * * *